United States Patent [19]

Peters

[11] 4,082,871

[45] Apr. 4, 1978

[54] METHOD FOR FORMING A DECORATIVE NOVELTY DEVICE

[76] Inventor: Alan Peters, 28 Westhampton Dr., Weston, Ontario, Canada

[21] Appl. No.: 756,875

[22] Filed: Jan. 5, 1977

[51] Int. Cl.[2] ..... B44C 1/16

[52] U.S. Cl. ..... 428/15; 40/124.5; 427/256; 427/299; 428/914; 428/540

[58] Field of Search ..... 40/124.5; 252/89 R; 428/7, 13, 15, 914, 79, 187, 28; 427/256, 299, 146, 147, 148, 149

[56] References Cited

U.S. PATENT DOCUMENTS

| | | | |
|---|---|---|---|
| 271,209 | 1/1883 | Bartlett | 428/162 |
| 320,947 | 6/1885 | McCusker | 428/15 |
| 3,110,736 | 11/1963 | DeGroote et al. | 252/89 X |
| 3,401,069 | 9/1968 | Lorentzen | 428/315 X |
| 3,438,159 | 4/1969 | Bergener et al. | 40/124.5 X |
| 3,562,076 | 2/1971 | Lea | 428/331 X |
| 3,570,159 | 3/1971 | Burgener, Jr. et al. | 40/124.5 X |
| 3,578,538 | 5/1971 | Prosser et al. | 156/253 X |
| 3,654,046 | 4/1972 | Crane | 428/16 |
| 3,684,292 | 8/1972 | Penrod et al. | 428/15 X |
| 3,955,018 | 5/1976 | Liberto et al. | 428/16 |

*Primary Examiner*—George F. Lesmes
*Assistant Examiner*—Henry F. Epstein
*Attorney, Agent, or Firm*—Charles J. Speciale

[57] ABSTRACT

A method of forming a decorative novelty device using stone material which comprises treating the stone with a wash medium, applying one or more thin coatings of clear polyurethane, applying a decorative element, allowing the resultant decorated stone to dry, and finally applying one or more thin coatings of the clear polyurethane to form the final product. The final product, a decorative novelty item, is then suitably mounted for display.

7 Claims, 3 Drawing Figures

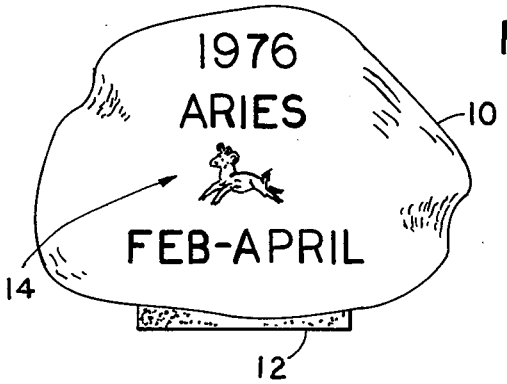
FIG. 1
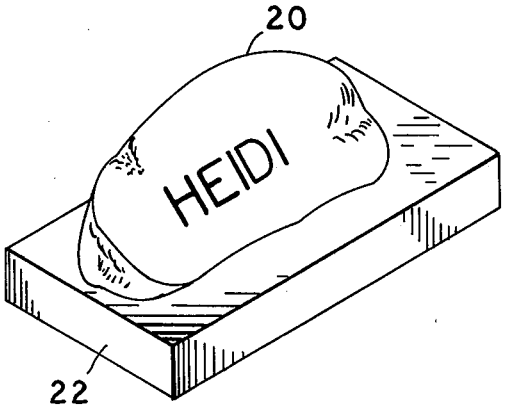
FIG. 2
FIG. 3
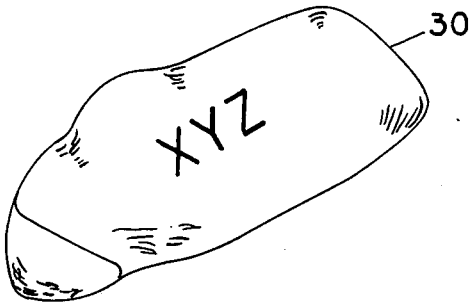

METHOD FOR FORMING A DECORATIVE NOVELTY DEVICE

BACKGROUND OF THE INVENTION

1. Field of the Invention

This invention relates to a method of forming a decorative novelty article having an esthetic appearance.

2. Description of the Prior Art

Decorative novelty articles for display use on desks, wall shelves and furniture, both for the home and office, are numerous. Some have first names, some have company names or trade names, some have slogans. Even "pet rocks" have now become the rage. Representative patents in the general area of this invention are U.S. Pat. Nos. 320,947 (art of decorating shells); 3,654,046 (an article illustrative of a particular geographic location); and 3,955,018 (a method of coating a porous mass of coral for use as an ornamental piece in aquariums). None of the foregoing, however, disclose the method of the present invention wherein a stone material is treated in a special way to provide a unique novelty article.

SUMMARY OF THE INVENTION

It is, therefore, among one of the principal objectives of this invention to provide a method of forming a decorative novelty article not heretofore produced by the prior art.

In accord with the invention there is now provided a method of forming a decorative novelty device using stone material which comprises treating the stone with a wash medium, such as water or a mild detergent solution of detergent and water, applying one or more thin coatings of clear polyurethane to the stone while still wet, applying a decorative element, such as water soluble decal or by silk screen printing, to the polyurethane coated surface of the stone, allowing the resultant decorated stone to dry, and finally applying one or more thin coatings of the clear polyurethane to form the final decorated product.

BRIEF DESCRIPTION OF THE DRAWING

The invention will be hereinafter more fully described with reference to the accompanying drawing in which:

FIG. 1 is an elevated front plan view of one application of the invention method;

FIG. 2 is a perspective view of yet another application of the invention method; and FIG. 3 is a perspective view of still another application of the method.

DESCRIPTION OF THE PREFERRED EMBODIMENTS

To make a decorative novelty device in accordance with the method of invention, stones of approximately 3 × 5 inches (while this size is preferred the dimensions can vary widely), and preferably multi-colored stones found on many rock-strewn beaches in Northern climes are employed. It is also helpful if the stone used presents at least one relatively smooth surface, although this is not necessary since the invention will work with any stone. The method comprises the following steps:

1. The stone selected is washed and cleaned thoroughly bringing out the color luster - water or mild detergent and water can be used as the washing medium.

2. While the stone is still wet at least one thin coating of clear polyurethane is applied to retain its luster - several thin coatings may also be applied if necessary. The polyurethane is soluble in alcohol or water for ease of application.

3. Next, either a water soluble decal is applied to a smooth surface of the stone or silk screen printing may be employed to accomplish the decorative feature.

4. The decorative element is allowed to dry.

5. Finally, at least one, and preferably a plurality, of thin coatings of clear polyurethane are applied to cover and protect the decorative element on the stone.

The decorative elements can be a child's name, a greeting such as "Birthday Rock" or "Christmas Rock," a zodiac sign, a logo-promotion of a corporate name, or the name of a favorite sports team. The possibilities are myriad.

For example, FIG. 1 shows a rock 10, having a felt base 12 mounted thereto, so that it can be placed on furniture without scratching, and showing a decorative element 14. In this case the decorative element depicts the zodiac sign "Aries" with the present year and the months of the sign. As mentioned earlier, the decorative element can be a water soluble decal mounted to a relatively smooth surface of the stone, if any, or it can be silk screen printed on, in a manner well known to the art.

FIG. 2 shows another rock 20 mounted to a flat wood base 22, and showing a child's name "Heidi" as the decorative element.

Finally, FIG. 3 shows yet another rock 30 treated in the manner according to the invention and showing lettering "XYZ" which can be the name of a sports team or the name of a corporation. No base is provided in this case.

What is claimed is:

1. A method of forming a decorative novelty article from a stone substrate comprising the steps of:

treating the stone with an aqueous wash medium;

applying to said stone while still wet at least one thin coating of clear polyurethane solution;

affixing a decorative element selected from a water soluble decal or a silk screen printing to a resulting polyurethane coated surface of said stone;

allowing the resultingly decorated stone to dry; and applying at least one thin coating of said clear polyurethane solution to said decorated stone to form the final product.

2. A method according to claim 1 wherein said aqueous wash medium contains a detergent.

3. A method according to claim 1 wherein a plurality of thin coatings of said polyurethane solution are applied to said decorated stone.

4. A method according to claim 1 wherein a plurality of thin coatings of said polyurethane solution are applied to said stone while still wet and to said decorated stone.

5. A decorative novelty article comprising a washed stone substrate, said stone having at least one thin coating of clear polyurethane solution applied thereto, a decorative element selected from a water soluble decal or a silk screen printing affixed to said polyurethane solution coated stone and at least one thin coating of said clear polyurethane solution applied to said stone over said decorative element.

6. The novelty article according to claim 5 mounted to a felt base.

7. The novelty article according to claim 5 mounted to a flat wood base.

* * * * *